US012250979B2

(12) United States Patent
Brown

(10) Patent No.: US 12,250,979 B2
(45) Date of Patent: Mar. 18, 2025

(54) FLAME-RETARDANT PROTECTIVE BIB FOR SMOKING USERS

(71) Applicant: Alphonso Brown, Doral, FL (US)

(72) Inventor: Alphonso Brown, Doral, FL (US)

( * ) Notice: Subject to any disclaimer, the term of this patent is extended or adjusted under 35 U.S.C. 154(b) by 12 days.

(21) Appl. No.: 18/307,045

(22) Filed: Apr. 26, 2023

(65) Prior Publication Data

US 2023/0337760 A1 Oct. 26, 2023

Related U.S. Application Data

(60) Provisional application No. 63/335,070, filed on Apr. 26, 2022.

(51) Int. Cl.
*A41D 13/04* (2006.01)
*A41D 31/08* (2019.01)

(52) U.S. Cl.
CPC ..... *A41D 13/04* (2013.01); *A41D 31/08* (2019.02)

(58) Field of Classification Search
CPC ..... A41D 13/04; A41D 31/08; A41D 3/08; A41D 3/00; A41D 13/0518; A41D 27/20; A41B 13/103; A41B 13/10; A41B 13/106
USPC ..... 2/46–52
See application file for complete search history.

(56) References Cited

U.S. PATENT DOCUMENTS 3,146,465 A * 9/1964 Hummel ..... A41B 13/10 2/49.3
4,660,226 A * 4/1987 Quilling ..... A41B 13/103 2/49.4
4,811,428 A * 3/1989 Waldman ..... A41D 31/02 2/49.3
5,220,692 A * 6/1993 Cox ..... A41D 13/04 2/48
5,233,821 A * 8/1993 Weber, Jr. ..... A41D 19/01505 428/920
5,881,382 A * 3/1999 Bernard ..... A41B 13/10 2/48
RE36,868 E * 9/2000 Fisher ..... A61B 46/00 433/137
6,256,788 B1 * 7/2001 Loewer ..... A41B 13/103 2/52
6,308,875 B1 * 10/2001 Almo ..... A61B 50/20 224/660
6,484,333 B1 * 11/2002 Hill ..... B60N 2/6009 2/49.4

(Continued)

FOREIGN PATENT DOCUMENTS

WO WO-9519113 A1 * 7/1995 ..... A41B 13/10
WO WO-2007101081 A2 * 9/2007 ..... A41B 13/10

*Primary Examiner* — Amy Vanatta
(74) *Attorney, Agent, or Firm* — Brennan, Manna & Diamond, LLC

(57) ABSTRACT

A novel fire-retardant protective bib including a generally rectangular or square body having a front surface and a rear surface. The rear surface has a textile friendly adhesive material that may be detachably attached or laid across a clothing article of a smoking user such that the front surface of the bib collects ashes and debris dropped from a cigar, cigarette, *cannabis*, and the like. The bib is configured to cover a lap or chest area and a portion of the smoking user's torso, thereby preventing stains and burns on the clothing of the user. The bib also comprises a rear pocket for storing smoking items therein, and the front surface includes several customization options, such as a unique logo.

12 Claims, 4 Drawing Sheets

(56) References Cited

U.S. PATENT DOCUMENTS

| | | | | |
|---|---|---|---|---|
| 6,826,780 | B1 * | 12/2004 | Romesburg | A41B 13/103 2/48 |
| 7,512,993 | B1 * | 4/2009 | Gutierrez | A41B 13/10 2/49.1 |
| 9,320,304 | B1 * | 4/2016 | Sanders | A41B 13/103 |
| 9,468,242 | B1 * | 10/2016 | Lee | A41D 13/04 |
| 2005/0091722 | A1 * | 5/2005 | Walsh | A41D 13/04 2/48 |
| 2006/0174390 | A1 * | 8/2006 | Wakhloo | A41D 13/04 2/48 |
| 2007/0028342 | A1 * | 2/2007 | Chan | A41D 13/04 2/48 |
| 2008/0052801 | A1 * | 3/2008 | Monroe | A41D 13/04 2/49.4 |
| 2008/0209608 | A1 * | 9/2008 | Sheffield | A41D 13/0518 2/49.1 |
| 2012/0042431 | A1 * | 2/2012 | Lee | A41D 13/04 2/48 |
| 2012/0047617 | A1 * | 3/2012 | Didiodato | A61M 16/047 2/48 |
| 2012/0174279 | A1 * | 7/2012 | Bailey | A41B 13/103 2/48 |
| 2013/0086725 | A1 * | 4/2013 | Sabre | A41B 13/106 2/49.1 |
| 2023/0000177 | A1 * | 1/2023 | Weaver | A47G 11/002 |

* cited by examiner

FLAME-RETARDANT PROTECTIVE BIB FOR SMOKING USERS

CROSS-REFERENCE TO RELATED APPLICATION

The present application claims priority to, and the benefit of, U.S. Provisional Application No. 63/335,070, which was filed on Apr. 26, 2022, and is incorporated herein by reference in its entirety.

FIELD OF THE INVENTION

The present invention relates generally to the field of clothing protection devices. More specifically, the present invention relates to a novel protective bib for smoking users. The bib is used for protecting clothing of the user and nearby objects from hot ash and cold ash dropped from smoking *cannabis*, cigars, cigarettes, and more. The bib is fire-retardant and collects the ash (i.e., fallen or knocked off), thereby protecting the clothing from getting stained and/or burned. The bib is machine washable and can also be cleaned by wiping using a cloth or a sponge. Accordingly, the present disclosure makes specific reference thereto. Nonetheless, it is to be appreciated that aspects of the present invention are also equally applicable to other like applications, devices, and methods of manufacture.

BACKGROUND OF THE INVENTION

By way of background, individuals who smoke cigars, cigarettes, *cannabis*, etc. may have difficulty disposing of the ashes. Hot or cold ashes are dropped on clothing or personal property while smoking and can cause stains and may even permanently ruin the garment. The finer the powder of the ash, the more easily and quickly the ash gets deep into the fibers of garments rather than staying on the surface. Smear caused due to ash is visible from a long distance and can cause embarrassment to a person. Hot ashes can burn holes through clothes, personal property, and furniture. This not only causes monetary damage to property, but may also cause ash burn and cause significant injury to a person. Hot ash may leave a scar and often affects the top layer of skin that can penetrate deeper as well and likely leave a permanent mark.

Generally, individuals use techniques such as shaking the clothing, running the ash stains directly under a water faucet, treating the ash stain with dish soap, and/or washing the clothing in a washing machine for removing ash stains. Garments with holes caused from cigarette and cigar ash are ultimately not used by users forcing users to buy new clothing. As a result, individuals desire a device that can be used for covering a garment while smoking cigars, cigarettes, *cannabis*, etc.

Therefore, there exists a long-felt need in the art for a device that allows users to safely smoke in a home, vehicle, or any other location. There is also a long-felt need in the art for a device that eliminates worry of hot or cold ashes being dropped on clothing or furniture while smoking cigars, cigarettes, *cannabis* etc. Additionally, there is a long-felt need in the art for a novel device that can be used as a protective bib for a front chest area of a smoking user. Moreover, there is a long-felt need in the art for a device that can be draped over the front of a user for maintaining protection of clothing against ashes while smoking. Further, there is a long-felt need in the art for a device that prevents ash burns and stains on clothing due to cigarette and cigar ash. Finally, there is a long-felt need in the art for a device that prevents hot or cold ashes from staining or damaging clothing, furniture, and other nearby objects.

The subject matter disclosed and claimed herein, in one embodiment thereof, comprises a flame-retardant protective bib for safeguarding clothing of a smoking user from hot ash and cold ash dropped, or intentionally knocked off, from a smoking cigar, cigarette, *cannabis* and more. The bib is generally rectangular or square flame-retardant having a front surface and a rear surface. The rear surface having a pocket for storing cigarette, cigar, and more and has a pressure sensitive textile adhesive for removably attaching the bib to a clothing article of the user. The adhesive is preferably made of a durable, inherently flame-resistant meta-aramid fiber material known as NOMEX® and is sewn to the top edge of the rear surface. The front surface having a personalized logo preferably in the form of initials of the smoking user and a brand name sewn therein for customization and personalization.

In this manner, the flame-retardant protective bib of the present invention accomplishes all of the forgoing objectives and provides users with a protective bib covering for use while smoking cigars, cigarettes, *cannabis*, etc. The bib can be draped over the torso by a smoking user and protects the user and nearby objects from hot ash and cold ash. The bib can be customized allowing users to customize the look of the bib with different colors, embroidery, and more.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a flame-retardant protective bib for safeguarding clothing of a smoking user from hot ash and cold ash dropped from a smoking cigar, cigarette, *cannabis* and more. The bib comprising a generally rectangular or square flame-retardant flexible material having a front surface and a rear surface. The rear surface having a pocket for storing cigarettes, cigars, and more and has a pressure sensitive textile adhesive for removably attaching the bib to clothing article of the user. The front surface having a personalized logo and a brand name sewn therein for customization and personalization.

In yet another embodiment, the protective bib extends to cover a chest area of the smoking user and a portion of abdomen.

In yet another embodiment, protective bib is made of a durable, inherently flame-resistant meta-aramid fiber material known as NOMEX® and can be wiped clean using a cloth.

The subject matter disclosed and claimed herein, in one embodiment thereof, comprises a protective bib for safeguarding clothing of a smoking user from hot ash and cold ash dropping from the cigar, cigarette, *cannabis*, and more. The bib comprising a covering being generally square or rectangular in shape for covering a torso area of the user, the bib having a top edge, a bottom edge, and two side edges, two straps extending vertically upwards from opposite ends of the top edge, each strap having a textile friendly hook and loop fastener for removably attaching the bib to a clothing article of the user, wherein the bib is made of flame-retardant material which is easy to be wiped clean using a cloth, sponge, and the like.

In yet another embodiment, the bib having a front surface and a rear surface, the rear surface touches the clothing article of the user when the bib is donned by the user and the front surface projects away from the user.

In another aspect of the present invention, the bib has a personalized logo indicating initials of the user's name.

In yet another embodiment, a method for protecting clothing of a smoking user from ash dropping from smoking cigar, cigarette, *cannabis*, and more is described. The method comprising the steps of providing a flame-retardant bib, the bib having a rear surface having a hook and loop fastener and front surface having customized indicia; positioning the bib adjacent to the chest (i.e., clothing article) of the user such that the rear surface faces the clothing article; removably attaching the hook and loop fastener to the clothing by applying little pressure thereon; accommodating the ash dropped thereon; removing the bib from the clothing; and cleaning the bib by wiping using a cloth, sponge, and the like.

In yet another embodiment, the fire-retardant protective bib of the present invention is easily and efficiently manufactured, marketed and available to consumers in cost-effective manner and is easily used by users for maintaining protection against ashes while smoking.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1B:
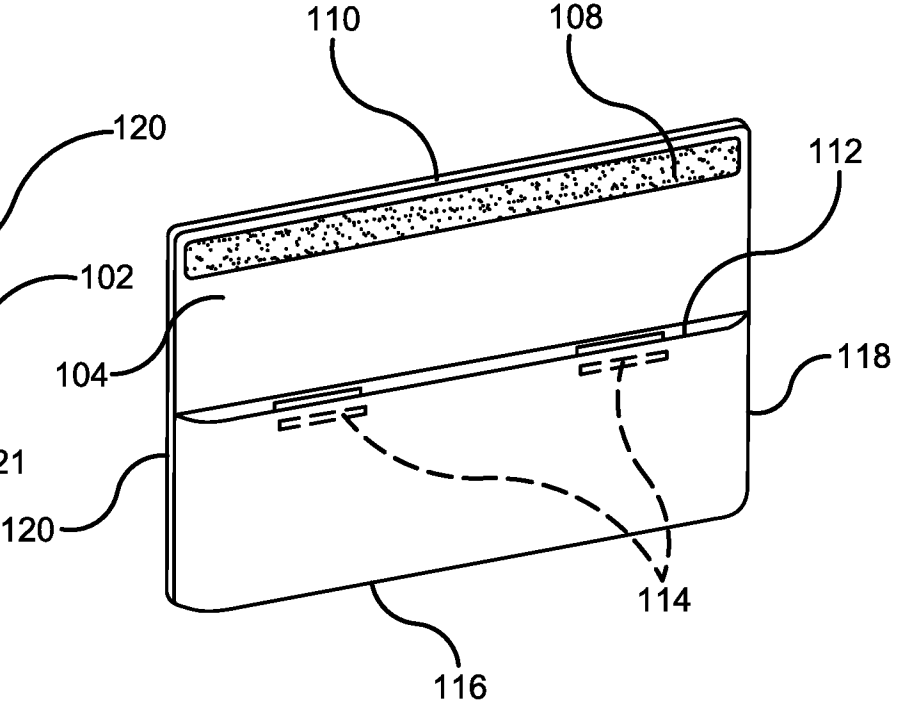
FIG. 1B illustrates rear perspective view of one potential embodiment of the fire-retardant protective bib of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a device that allows users to safely smoke in a home, vehicle, or any other location. There is also a long-felt need in the art for a device that eliminates worry of hot or cold ashes being dropped on clothing or furniture while smoking cigars, cigarettes, *cannabis*, etc. Additionally, there is a long-felt need in the art for a novel device that can be used as a protective bib for a front chest area of a smoking user. Moreover, there is a long-felt need in the art for a device that can be draped over the front of a user for maintaining protection against ashes while smoking. Further, there is a long-felt need in the art for a device that prevents ash burns and stains on clothing due to cigarette and cigar ash. Finally, there is a long-felt need in the art for a device that prevents hot or cold ashes from staining or damaging clothing, furniture, and other nearby objects.

The present invention, in one exemplary embodiment, is a method for protecting clothing of a smoking user from ash dropping while smoking a cigar, a cigarette, a *cannabis* cigarette, and more. The method comprising the steps of providing a flame-retardant bib, the bib having a rear surface having a hook and loop fastener along the lateral top edge thereof and a front surface having customized indicia. The method further includes positioning the bib proximal to a chest area and a portion of an abdomen area of the user such that the rear surface faces the clothing; removably attaching the hook and loop fastener to the clothing by applying pressure thereon; accommodating the ash dropped thereon; removing the bib from the clothing; and cleaning the bib by wiping using a cloth, sponge and the like.

Figure 1A:
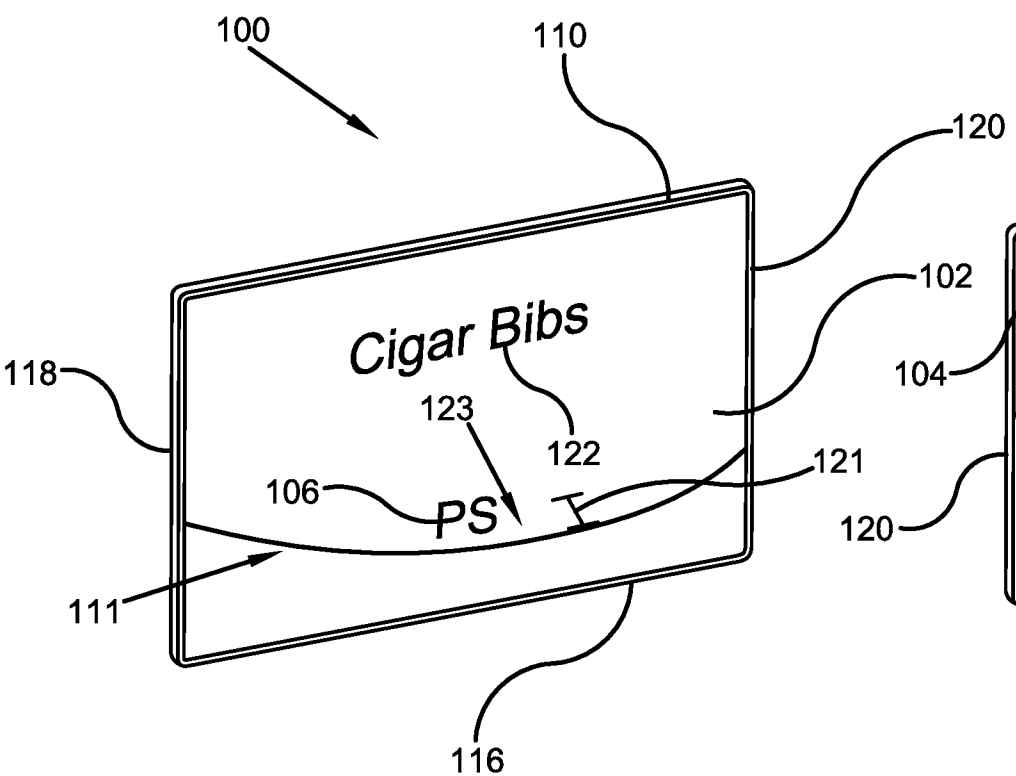
FIG. 1A illustrates front perspective view of one potential embodiment of a fire-retardant protective bib of the present invention in accordance with the disclosed architecture.

Referring initially to the drawings, FIGS. 1A and 1B illustrate a front perspective view and a rear perspective view, respectively, of one potential embodiment of a fire-retardant protective bib of the present invention in accordance with the disclosed architecture. The flame-retardant protective bib 100 of the present invention is in the form of a generally planar piece of material and designed to cover a front torso area of a smoking user for protecting the user's clothing from hot and cold ash dropping from the smoking instruments including, but not limited to, cigars, cigarettes, *cannabis*, and more. More specifically, the protective bib 100 is generally rectangular or square in one potential embodiment and has a front surface 102 and a rear surface 104. The surfaces are formed by a common top edge 110, a common bottom edge 116, and a pair of side edges 118, 120. The rear surface 104 touches the clothing article of a smoking user when the bib 100 is used by the user and the front surface 102 projects away from the torso, thereby being visible to other users. The front surface 102 includes a front pocket 111 disposed therein for collecting ashes and debris that fall onto the front surface 102. The pocket 111 protrudes outward a distance 121 from the front surface 102 to form an open pouch 123 in order to capture ashes 205 and debris that fall from the mouth area of the user.

The front surface 102 can include a personalized logo 106 which can be in the form of an insignia, a badge, an emblem, a decoration, an alphanumeric symbol, or an artistic rendition that adheres, either permanently or removably, to the front surface 102. In the preferred embodiment, the logo 106 is in the form of initials of a user owning the bib 100. The rear surface 104 has a textile adhesive hook and loop fastener 108 around the top edge 110 thereof allowing the protective bib 100 to be removably attached to a clothing article worn by the smoking user to cover the torso.

The bib 100 has a width of from about 10 inches to about 20 inches and a length from about 12 inches to about 24 inches to meet requirements of different smoking users. The rear surface 104 also includes a rear pocket 112 disposed therein for removably storing cigarettes, cigars, lighter, cigar cutter, and more. The pocket 112 has a hook and loop fastener 114 for securing the items stored therein. The bib 100 is made of a fire-retardant and flexible material. The bib 100 is inherently flame resistant ensuring a high level of protection against holes and burns that can result from hot ashes dropping thereon. The bib 100 is color fast and machine washable and is preferably made of a durable, inherently flame-resistant meta-aramid fiber material known as NOMEX®. The bib 100 in the present embodiment is not wrapped around a neck of the wearer and is easy and convenient to deploy and use. The brand name 122 used for branding and marketing purposes is preferably disposed on the front surface 102 of the bib 100.

Once in position and worn, the bib 100 extends partially over the chest/torso of the user covering the chest and optionally a portion of the abdomen of the user. The user is free to smoke, drink, and even eat as necessary, without having to worry about ruining his or her clothing. The bib 100 is non-slippery and can be shaken easily to remove any ash retrieved thereon and/or captured in the front pocket 111.

Figure 2:
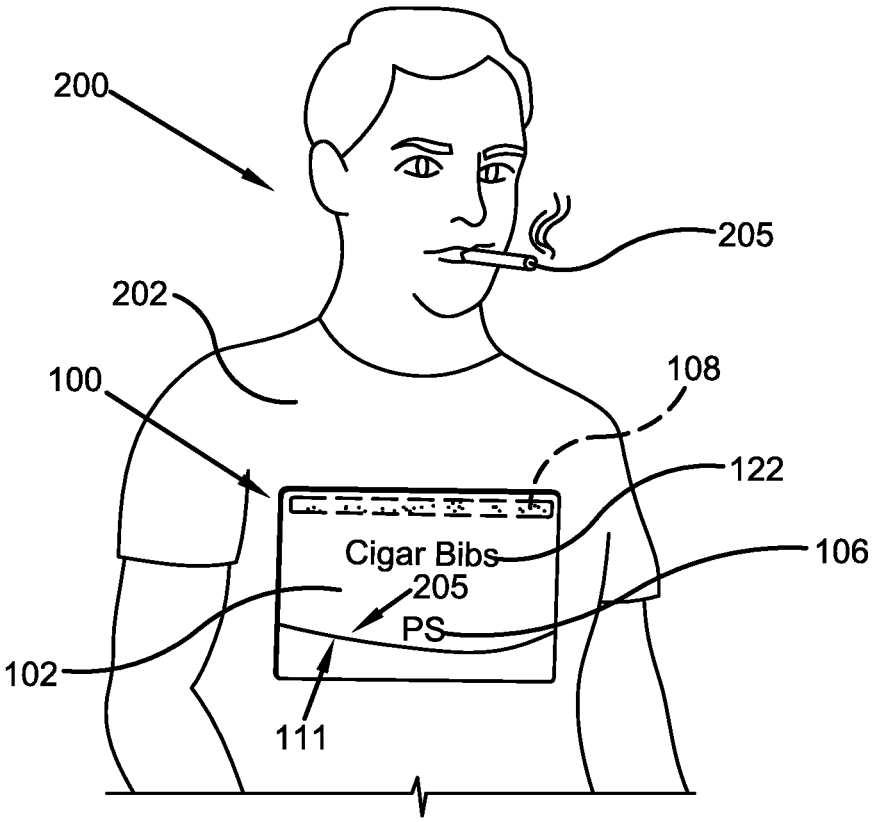
FIG. 2 illustrates a perspective view of a user wearing the fire-retardant protective bib of the present invention in accordance with the disclosed architecture.

FIG. 2 illustrates a perspective view of a user wearing the fire-retardant protective bib of the present invention in accordance with the disclosed architecture. A smoking user 200 can removably wear the bib 100 by attaching the textile adhesive hook and loop fastener 108 positioned on the rear surface 104 to a shirt or any other garment 202 worn by the user 200. The bib 100 covers a substantial portion of the chest of the user 200 while also covering a portion of the abdomen depending on the length/height of the bib 100. The fastener 108 is pressure-sensitive and has shear properties and preferably is 100% polyamide woven fabric with rubber based adhesive properties, which is ideal for flame retardant properties. The fastener 108 is sewn and is integrated to the bib 100 and is machine washable.

Figure 3:
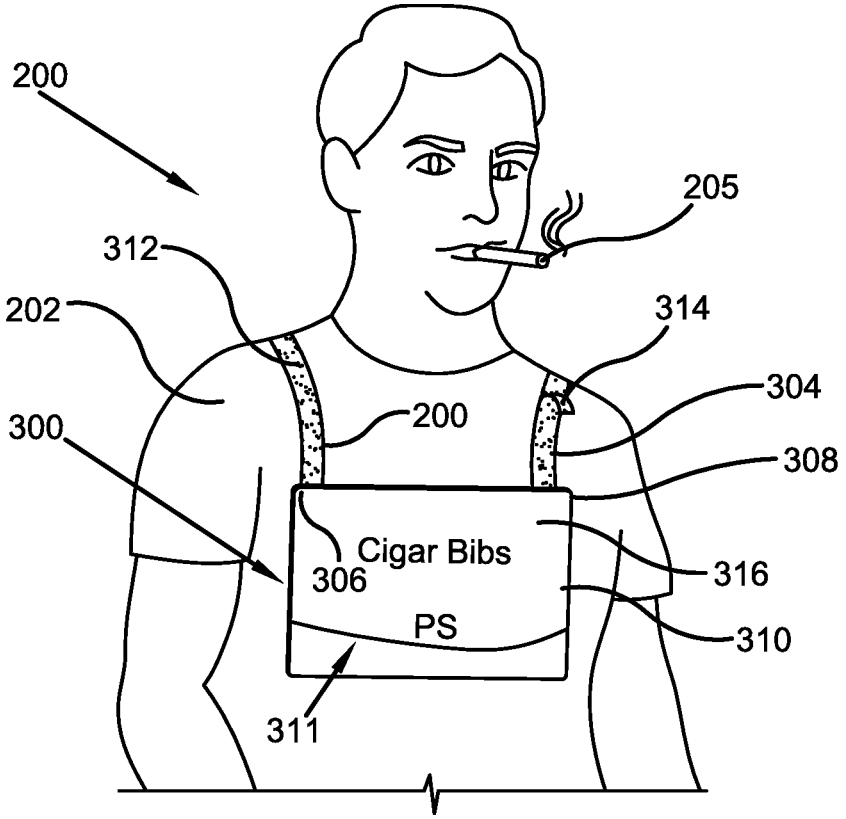
FIG. 3 illustrates a perspective view showing the smoking user wearing another potential embodiment of the fire-retardant protective bib of the present invention in accordance with the disclosed architecture.

FIG. 3 illustrates a perspective view showing the smoking user 200 wearing another potential embodiment of the fire-retardant protective bib of the present invention in accordance with the disclosed architecture. The bib 300 of the present embodiment has a pair of straps 302, 304 extended vertically upwards from the top corner ends 306, 308 of the main body 310. The main body 310 includes a front pocket 311 projecting therefrom. The straps 302, 304 have textile adhesive fasteners 312, 314 respectively disposed on rear surfaces thereof for allowing the user 200 to removably attach the bib 300 to protect the garment 202 and nearby objects.

The bib 300 safeguards clothing from spills, stains, or burns, while eating, drinking, or smoking in a home, vehicle, or any other location. After use, the bib 300 can be easily removed from the clothing article 202 and can be stored in a pocket, bag, or the like. The bib 300 can be easily wiped clean with a sponge, towel, napkin, and the like. Other specifications of the front surface 316 and the rear surface (opposite to the front surface 316) can be similar to the other embodiments of the present invention.

Figure 4:
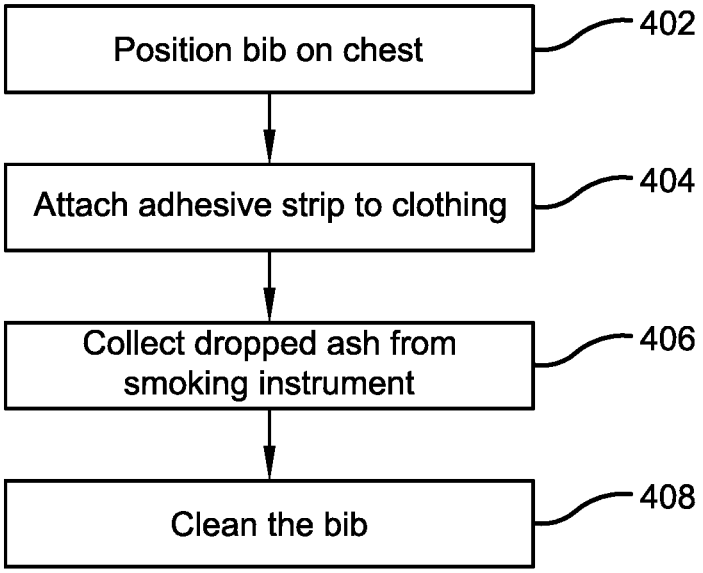
FIG. 4 illustrates a flow diagram depicting a process of protecting clothing and nearby objects using the protective bib of the present invention in accordance with the disclosed architecture.

FIG. 4 illustrates a flow diagram depicting a process of protecting clothing (i.e., clothing articles) and nearby objects using a protective bib of the present invention in accordance with the disclosed architecture. Initially, the bib is positioned on, or in front of, a chest area and a portion of the abdomen area of a smoking user (Step 402). The bib is positioned such that the rear surface thereof faces the clothing of the user. Then, the adhesive surface positioned on the rear surface and/or the straps are detachably attached to the clothing article of the user (Step 404). The bib extends downward from the neck portion to the abdomen portion of the user. Thereafter, the ash dropped from the smoking instrument can be collected by the bib such that clothing is protected from stains and burning of the ash (Step 406). Finally, the adhesive is removed and the bib is cleaned using machine wash, wiping using a cloth or other means for allowing the user to reuse the bib (Step 408).

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "fire-retardant protective bib", "flame-retardant protective bib", "protective bib", and "bib" are interchangeable and refer to the flame-retardant protective bib 100, 300 of the present invention.

Notwithstanding the forgoing, the flame-retardant protective bib 100, 300 of the present invention can be of any suitable size and configuration as is known in the art without affecting the overall concept of the invention, provided that it accomplishes the above-stated objectives. One of ordinary skill in the art will appreciate that the flame-retardant protective bib 100, 300 as shown in the FIGS. are for illustrative purposes only, and that many other sizes and shapes of the flame-retardant protective bib 100, 300 are well within the scope of the present disclosure. Although the dimensions of the flame-retardant protective bib 100, 300 are important design parameters for user convenience, the flame-retardant protective bib 100, 300 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A fire-retardant protective bib for a clothing article, the fire-retardant protective bib comprising:

a generally planar front side and a generally planar rear side for covering a front torso area and a portion of an abdomen of a user;

a strap connected proximal to a top edge of said rear side, wherein said strap is configured to loop around a user's shoulders to hold said fire-retardant protective bib close to the user's torso;

wherein said front side having an upwardly oriented front pocket proximal to a bottom edge of said front side;

wherein said rear side having an upwardly oriented rear pocket proximal to a bottom edge of said rear side;

wherein said fire-retardant protective bib having a flame-retardant material;

wherein said upwardly oriented front pocket formed into a pouch positioned in front of the torso area of the user for collectin ashes and debris falling from a mouth area of a user on said front side of said fire-retardant protective bib;

wherein said collected ashes are from a source consisting of a cigarette, a cigar, and a *cannabis* cigarette;

wherein said front side and said rear side have a pair of common side edges;

wherein a rear surface of said rear side touches a front surface of a clothing article worn by the user and said front pocket is configured to project away from the torso of the user; and wherein said rear surface having a textile adhesive hook and loop fastener proximal to said top edge for adhering to the clothing article of the user.

2. The fire-retardant protective bib of claim 1, wherein said fire-retardant protective bib is rectilinear.

3. The fire-retardant protective bib of claim 1, wherein said front side and said rear side have a common top edge and a common bottom edge.

4. The fire-retardant protective bib of claim 1, wherein said fire-retardant protective bib having a width of from about 10 inches to about 20 inches and a length from about 12 inches to about 24 inches.

5. The fire-retardant protective bib of claim 1, wherein said upwardly oriented rear pocket having a hook and loop fastener selectively connectable with said rear side.

6. The fire-retardant protective bib of claim 1, wherein said flame-retardant material comprises meta-aramid fiber.

7. A fire-retardant protective bib for a clothing article, the fire-retardant protective bib comprising:

a generally planar front side and a generally planar rear side for covering a front torso area and a portion of an abdomen of a user;

wherein said front side having an upwardly oriented front pocket proximal to a bottom edge of said front side;

wherein said rear side having an upwardly oriented rear pocket proximal to a bottom edge of said rear side;

wherein said rear side having a strap connected proximal to a top edge of said rear side;

wherein said strap securable around a user's shoulder to hold said fire-retardant protective bib close to a user's said front torso area;

wherein said fire-retardant protective bib having a flame-retardant material;

wherein said upwardly oriented front pocket formed into a pouch positioned in front of the torso area of the user for collecting ashes and debris falling from a mouth area of a user on said front side of said fire-retardant protective bib;

wherein said collected ashes are from a source consisting of a cigarette, a cigar, and a *cannabis* cigarette;

wherein said front side and said rear side have a pair of common side edges;

wherein said rear surface touches a front surface of a clothing article worn by the user and said front pocket is configured to project away from the torso of the user; and wherein a rear surface of said rear side having a textile adhesive hook and loop fastener proximal to said top edge for adhering to the clothing article of the user.

8. The fire-retardant protective bib of claim 7, wherein said fire-retardant protective bib having a width of from about 10 inches to about 20 inches and a length from about 12 inches to about 24 inches.

9. The fire-retardant protective bib of claim 7, wherein said upwardly oriented rear pocket having a hook and loop fastener selectively connectable with said rear side.

10. The fire-retardant protective bib of claim 9, wherein said flame-retardant material comprises meta-aramid fiber.

11. A fire-retardant protective bib for a clothing article, the fire-retardant protective bib comprising:

a generally planar front side and a generally planar rear side for covering a front torso area and a portion of an abdomen of a user;

wherein said front side having an upwardly oriented front pocket proximal to a bottom edge of said front side;

wherein said rear side having an upwardly oriented rear pocket proximal to a bottom edge of said rear side;

wherein said rear side having a strap connected proximal to a top edge of said rear side;

wherein said strap securable around a user's shoulder to hold said fire-retardant protective bib close to a user's said front torso area;

wherein said fire-retardant protective bib having a flame-retardant material;

wherein said upwardly oriented front pocket formed into an open pouch positioned in front of the torso area of the user for collecting ashes and debris falling from a mouth area of a user on said front side of said fire-retardant protective bib;

wherein said collected ashes are from a source consisting of a cigarette, a cigar, and a *cannabis* cigarette;

wherein a rear surface of said rear side touches a front surface of a clothing article worn by the user and said front pocket is configured to project away from the torso of the user; and further wherein said rear surface having a textile adhesive hook and loop fastener proximal to said top edge for adhering to the clothing article of the user.

12. The fire-retardant protective bib of claim 11, wherein said flame-retardant material comprises meta-aramid fiber.

* * * * *